United States Patent [19]

Köbler

[11] Patent Number: 4,599,943

[45] Date of Patent: Jul. 15, 1986

[54] ELECTROSTATIC-CHARGE-AND CHEMICAL-ATTACK-RESISTANT PRINTING CYLINDER CONSTRUCTION

[75] Inventor: Ingo Köbler, Anhausen, Fed. Rep. of Germany

[73] Assignee: M.A.N. - Roland Druckmaschinen Aktiengesellschaft, Offenbach, Fed. Rep. of Germany

[21] Appl. No.: 677,186

[22] Filed: Dec. 3, 1984

[30] Foreign Application Priority Data

Jan. 17, 1984 [DE] Fed. Rep. of Germany ..... 3401350

[51] Int. Cl.[4] ..... B41F 7/02; B41F 1/28; B41F 29/02

[52] U.S. Cl. ..... 101/217; 101/142; 101/401.1; 101/415.1; 101/DIG. 13; 355/3 P; 361/221; 428/909

[58] Field of Search ..... 101/378, 395, 415.1, 101/142, 217, DIG. 13, 401.1; 346/138, 162, 163, 164; 355/3 P; 361/212, 214, 220, 221; 428/909

[56] References Cited

U.S. PATENT DOCUMENTS

| | | | |
|---|---|---|---|
| 2,629,324 | 2/1953 | Smith | 101/415.1 |
| 2,996,646 | 8/1961 | Wilson | 361/221 |
| 3,235,772 | 2/1966 | Gurin | 101/415.1 |
| 4,049,343 | 9/1977 | Hermanson | 361/221 |
| 4,132,826 | 1/1979 | Dessauer | 428/909 |
| 4,320,714 | 3/1982 | Shimazaki | 361/221 |

FOREIGN PATENT DOCUMENTS

| | | | |
|---|---|---|---|
| 1049394 | 9/1959 | Fed. Rep. of Germany | 101/415.1 |

OTHER PUBLICATIONS

Chatto, Electrostatic Reducing Tape Handling Devices, IBM Technical Disclosure Bulletin, vol. 12, No. 10, Mar. 1970, p. 1625.

*Primary Examiner*—William Pieprz

*Attorney, Agent, or Firm*—Frishauf, Holtz, Goodman & Woodward

[57] ABSTRACT

To draw off electrostatic charges which build up on rubber blanket cylinders having a coating of insulating or semiconductive material thereon, the pad or underlay (4) beneath the rubber blanket (5) has an electrically conductive layer (6), for example by sprayed-on aluminum, applied thereon. The end portion (B) of the pad is drawn into the groove (2) of the cylinder (C) in a region which does not have an insulating coating (3) thereon, so that the electrically conductive layer (6) is electrically connected with the cylinder (C) in the region (A) of the cylinder groove. The cylinder, typically of steel, is connected to ground or chassis through its holding structure, frame and gearing.

4 Claims, 1 Drawing Figure

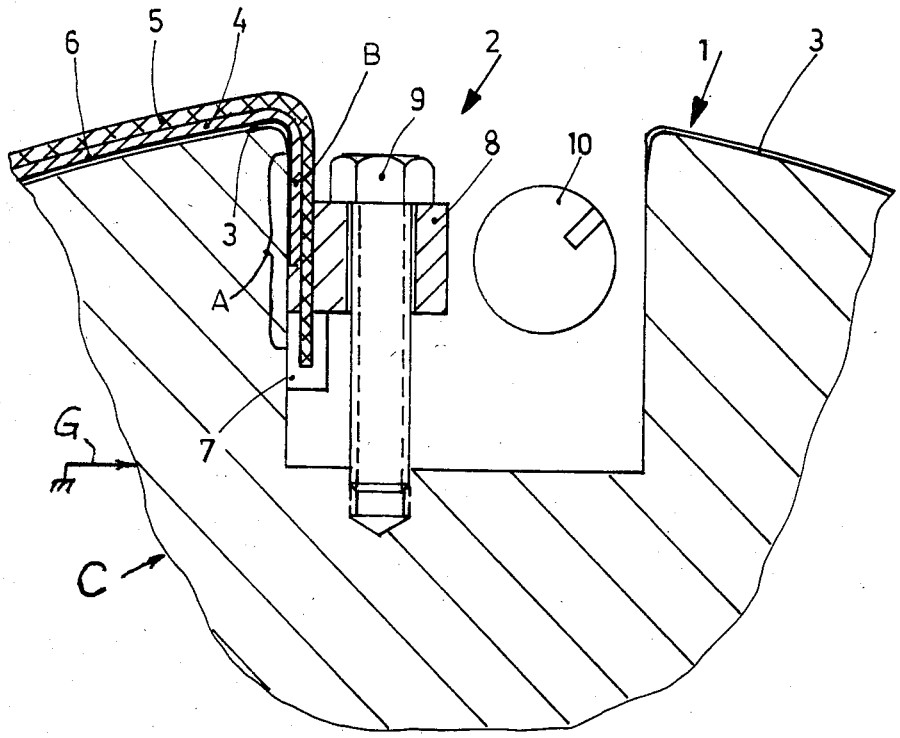
6
5
4
B
2
1
3
9
8
10
3
A
7
G
C

ELECTROSTATIC-CHARGE-AND CHEMICAL-ATTACK-RESISTANT PRINTING CYLINDER CONSTRUCTION

The present invention relates to offset rotary printing machines, and more particularly to a rubber blanket cylinder-rubber blanket combination, in which the blanket cylinder has an axially extending cylinder groove in which clamping devices are located to attach the ends of a rubber blanket wrapped about the cylinder.

BACKGROUND

In many printing installations, it is customary to provide a pad or cushion between the rubber blanket and the blanket cylinder. German Pat. No. 1,049,394 describes a cover or pad for a rubber blanket cylinder for offset rotary printing machines, in which the rubber blanket has a porous, elastic pad therebeneath. A somewhat flexible, that is, bendable metallic plate which, however, is inelastic in comparison to the rubber blanket, is located between the rubber blanket and the pad. This plate is intended to improve the printing quality.

It is frequently necessary, or desirable, to cover the surface of the rubber blanket cylinder with a protective coating since the cylinder is contacted by chemically aggressive liquids. Typical coatings ar nickel, chromium, and alloys, as well as electrically non-conductive materials, such as ceramics, Teflon (trademark) or silicone coatings. It has been found that a coating on the rubber blanket cylinder which is electrically non-conductive or only poorly conductive, for example semiconductive, causes, in due course, damage to the surface of the cylinder or, respectively, to its cover layer. Even taking particular care in application of the cover layer did not result in improvement in damage to the cover layer.

THE INVENTION

It is an object to provide a rubber blanket cylinder-blanket cylinder combination in which the rubber blanket cylinder has an electrically non-conductive or semiconductive coating thereon, in which damage to the surface of the cylinder is avoided.

Briefly, it appears that the damage to the cylinder may be due to electrostatic charges which will build up on the blanket, and which cannot be conducted away by the surface of the cylinder if the surface is non-conductive or electrically only poorly conductive. The damage to the insulating layer apparently is caused by the electrical charge which occurs on the insulating layers and, for example, on a pad or underlay, and which cannot be electrically conducted away by the rubber blanket cylinder which, through its bearings and connection to the frame of the machine, is normally grounded.

In accordance with a feature of the invention, and to carry away electrostatic charges, and electrically conductive layer is applied to the surface of a pad, underlay, or the like, which is placed beneath the rubber blanket and which contacts the surface layer of the surface of the rubber blanket cylinder. The electrically conductive layer is electrically connected to ground or chassis, that is, to the rubber blanket cylinder, for example at an end portion of the underlay in contact with the clamping groove of the blanket in the blanket cylinder, and from which the electrically non-conductive or semiconductive layer has been omitted.

Drawing:

The single FIGURE is a fragmentary cross-sectional view through a portion of a rubber blanket cylinder in the region of the attachment groove for a rubber blanket, and showing one end portion of the rubber blanket-pad or underlay system.

DETAILED DESCRIPTION

A rubber blanket cylinder C has a surface 1 which is coated with a protective coating 3 of electrically non-conductive or only semiconductive material, which is applied in order to protect the surface of the cylinder 1 from attack by corrosive or chemically aggressive materials, for example liquids. Typical coatings are Teflon coatings, silicone coatings, silicon coatings, or coatings made of chemically highly resistant semiconductive material. A preferred coating frequently used is a ceramic coating. Ceramic coatings, as is known, are particularly resistant with respect to attack by aggressive chemicals.

The cylinder C has an axially extending groove 2. The protective coating 3 is applied over an initial surface portion of the groove 2 in order to improve the protective effect as well as the adhesion of the protective coating 3 on the surface 1 of the rubber blanket cylinder. A pad or underlay 4 is usually applied to the surface of the rubber blanket cylinder; such a pad may be made of paper, cardboard, felt, or the like. The pad 4 is placed beneath the rubber blanket 5 in order to obtain the customary roll-off dimensions and diameters, as well as the engagement pressures which are used in the printing machine.

It has been found that, in accordance with the present invention, electrostatic charges will build up on the insulating materials forming the pad 4 and the blanket 5 which cannot be drawn off by the grounded cylinder C due to the intervening non-conductive or semiconductive coating or layer 3. In accordance with a feature of the invention, the surface of the pad 4 which is in contact with the insulating protective layer has an electrically conductive layer or coating 6 applied thereon. The electrically conductive layer or coating 6 may, for example, be made by vapor-depositing or spraying a layer of aluminum on the surface of the pad 4 which is to contact the coating 3 on the surface of the cylinder C. In accordance with a further feature of the invention, the side walls of the cylinder groove 2 are so constructed that at least a portion thereof, which is sufficiently large to come in contact with the electrically conductive layer 6 on the pad, is also electrically conductive. The region A of the side wall of the groove 2—see the FIGURE—is made to be electrically conductive, for example by blanking off or omitting the insulating or semiconductive coating 3 thereon. In accordance with a feature of the invention, at least one end of the underlay 4 is inserted into the cylinder groove 2, and so placed that the electrically conductive layer 6 on the end or terminal portion B of the underlay or pad 4 will be electrically contacted by the electrically conductive side wall portion A of the groove 2 of the cylinder C.

The end region B of the pad 4 as well as the end portion of the rubber blanket 5 are attached to the groove, for example, by engaging a connecting rail 8 extending axially across the groove with the rubber blanket 5. Preferably, the rubber blanket 5 is formed with a reinforcement strip 7. Screws 9, secured into the blanket cylinder, are used to attach the blanket 5, with the reinforcing rail 7 bearing against rail 8, in the groove 2. The other end of the blanket 5—not shown in the FIGURE—can be stretched and tightened in customary manner by introducing the other end into a slit of a tensioning spindle 10, shown only schematically, since such tensioning arrangements are well known in the printing machine field. Any suitable and customary arrangement may be used.

The conductive layer 6 on the underside of the pad 4 then will be electrically grounded, as schematically shown by the connection G through the frame of the machine, by electrical connection to the cylinder C in the region A.

The electrically conductive layer 6, connected in the region A electrically with the groove 2 of the cylinder C, permits discharge of electrostatic charges which build up, in operation, on the rubber blanket end on the pad 4. The ground connection of the cylinder C extends, for example, through the gear drive to the frame or chassis of the printing machine, as well as through other elements providing for metal-to-metal contact which may be provided and which ground the cylinder C to the chassis and frame of the machine. The frame of the machine, usually, is firmly secured to a grounded base.

Various changes and modifications may be made within the scope of the inventive concept.

I claim:

1. An electrostatic-degradation-resistant rubber blanket cylinder-rubber blanket combination for an offset rotary printing machine comprising at least one rubber blanket cylinder (C);

an aggressive-chemical-resistant but electrostatically vulnerable coating layer (3) on said at least one rubber blanket cylinder (C), said rubber blanket cylinder (C) being formed with an axially extending groove (2) to receive end portions of the rubber blanket (5), said groove having opposed side walls, said layer covering only a portion of the side walls of said groove;

means (8, 9, 10) for stretching the rubber blanket (5) about the circumference of the cylinder and for clamping the blanket in position;

an underlay or pad (4) having an underlay end portion (B) of electrically poorly conductive material interposed between the rubber blanket (5) and said electrically poorly conductive surface layer (3);

means for protecting said aggressive-chemical-resistant but electrostatically vulnerable coating layer (3) from electrostatic charge, said means including an electrical highly conductive layer (6) applied to that surface of the underlay or pad (4) which contacts the poorly conductive surface layer (3) of the cylinder (C), said electrically conductive layer (6) being electrically connected to ground or chassis (G);

said rubber blanket stretching and clamping means being arranged to clamp said underlay end portion (B) of said underlay or pad (4) to a side wall of said groove (2) in said cylinder (C) with said highly conductive layer (6), of said underlay or pad (4), against said side wall to electrically ground said highly conductive layer (6).

2. Combination according to claim 1, wherein at least one end portion (B) of the underlay or pad (4) is located in the groove (2) of the cylinder;

and said end portion is electrically connected with a side wall region (A) of the groove (2) in the cylinder (C) and which is electrically conductive.

3. Combination according to claim 1, wherein said electrically poorly conductive surface layer (3) on the surface of the cylinder (C) comprises a ceramic coating.

4. Combination according to claim 1, wherein the electrically highly conductive layer (6) applied to the surface of the underlay (4) which contacts the electrically poorly conductive surface layer (3) of the cylinder is formed by a spray-deposited layer of aluminum.

* * * * *